US005426855A

United States Patent [19]

Keklak et al.

[11] Patent Number: 5,426,855

[45] **Date of Patent: * Jun. 27, 1995**

[54] SAFETY UTILITY KNIFE

[75] Inventors: Ronald Keklak, Ridge Spring, S.C.; Michael V. Couture, South Hadley, Mass.; John C. Whitehouse, Edgefield, S.C.

[73] Assignee: PSI, Inc., South Hadley, Mass.

[ * ] Notice: The portion of the term of this patent subsequent to Apr. 19, 2011 has been disclaimed.

[21] Appl. No.: 228,858

[22] Filed: Apr. 18, 1994

Related U.S. Application Data

[63] Continuation-in-part of Ser. No. 983,175, Nov. 30, 1992, Pat. No. 5,303,474.

[51] Int. Cl.[6] ..... B26B 1/08

[52] U.S. Cl. ..... 30/162; 30/125; 30/335

[58] Field of Search ..... 30/125, 151, 162, 335, 30/336, 337, 2; 81/367

[56] References Cited

U.S. PATENT DOCUMENTS

| | | | |
|---|---|---|---|
| 3,577,637 | 5/1971 | Braginetz | 30/162 |
| 3,593,417 | 7/1971 | West et al. | 30/125 |
| 3,872,591 | 3/1975 | Quenot | 30/162 |
| 4,277,888 | 7/1981 | Szabo | 30/162 |
| 4,683,656 | 8/1987 | Peyrot et al. | 30/162 |
| 4,713,885 | 12/1987 | Keklak et al. | 30/162 |
| 4,757,612 | 7/1988 | Peyrot | 30/151 |
| 4,761,882 | 8/1988 | Silverstein | 30/162 |
| 5,303,474 | 4/1994 | Keklak et al. | 30/162 |

*Primary Examiner*—Hwei Siu Payer

*Attorney, Agent, or Firm*—Kimmel, Crowell & Weaver

[57] ABSTRACT

An improved safety utility knife has a hollow handle and a blade which is normally retracted within the handle, but can be extended by squeezing an operating lever. The lever is connected to the blade holder by a toggle linkage having a rearmost pin secured in a discrete support whose position is adjustable. A thumbscrew threaded into the support enables one to adjust the position of the support from outside the handle, and thus change how far the blade protrudes from the handle when the operating lever is fully depressed.

5 Claims, 5 Drawing Sheets

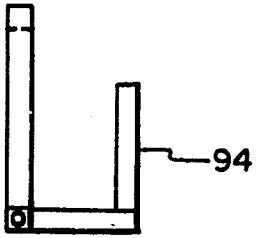
FIG. 11
FIG. 10
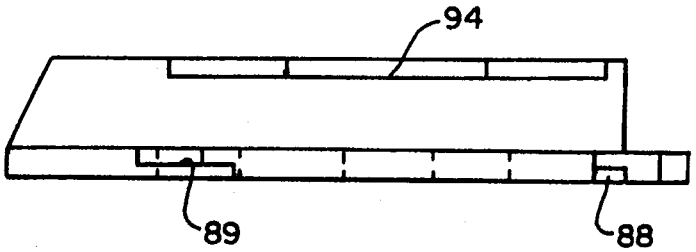
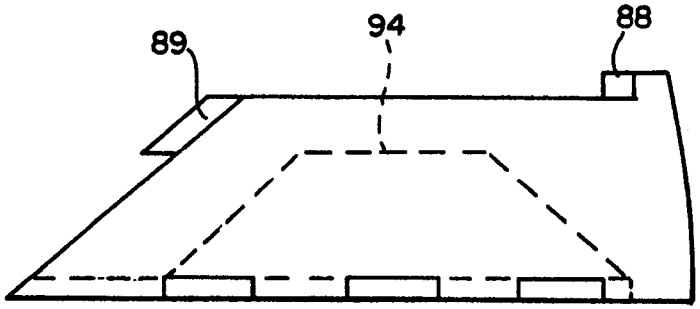
FIG. 9

SAFETY UTILITY KNIFE

This application is a continuation-in-part of application No. 07/983,175, filed Nov. 30, 1992, now U.S. Pat. No. 5,303,474.

BACKGROUND OF THE INVENTION

This invention relates to a utility knife, more particularly, to a knife having a replaceable blade which is normally retracted, and extends to a cutting position only when an operating lever is squeezed.

In most utility knives, a replaceable blade is immovably fixed at one end of a handle. The blade is constantly exposed, with consequent risks of injury to people or objects nearby while the knife is not in use.

To avoid this danger, prior inventors, including the present inventor, have proposed arrangements in which the blade is retractable into a shielded position, for example within the handle. U.S. Pat. No. 4,713,885, whose disclosure is incorporated herein by reference, is particularly pertinent. The knife disclosed in that patent has a hollow handle including, at one end, a retractable holder for a standard utility knife blade. A toggle linkage is mounted between a fixed point in the handle and the blade holder. A spring normally biases the blade holder rearward, but the spring bias is overcome when one squeezes an operating lever protruding from the bottom of the handle, extending the toggle linkage which forces the blade to its exposed position.

The prior device described above does not permit one to limit the extension of the blade, other than by only partially depressing the operating lever, which is awkward. Additionally, the prior device uses a torsion spring at the trigger pivot to bias the trigger; consequently, the maximum spring force is encountered at the blade-extended position, which can be tiring. Another problem is that the prior device does not permit the device to be locked, so that the lever cannot be operated.

SUMMARY OF THE INVENTION

Accordingly, an object of the invention is to provide a safety utility knife with means for limiting the extension of a blade, while affording the safety advantages found in a retractable-blade utility knife.

Another object of the invention is to provide an extensible-blade utility knife with good operating feel.

A further object is to enable one to store spare blades in an extensible-blade utility knife.

Yet another object is to provide an extensible and self-retracting utility knife in which application of a very small force suffices to keep the blade extended.

An additional object of the invention is to permit storage of a substantial number of replacement knife blades within the knife, and to permit ready access to them without requiring knife disassembly.

These and other objects are attained by an improved safety utility knife, generally of the type shown in U.S. Pat. No. 4,713,885, and comprising the improvement wherein the rearmost pin of the toggle linkage is held in a discrete support, rather than being fixed directly to the handle. This support is contained within the housing, but its position is adjustable. A thumbscrew is provided to enable one to adjust the position of the support from outside the handle, and thus change how far the blade protrudes from the handle when the operating lever is fully depressed.

The toggle link support position may be adjusted fore and aft by turning the thumbscrew, even to the point of preventing any extension of the blade out of the knife. Nevertheless, as a further safety precaution, there is also a position safety which locks the blade directly, and prevents blade extension regardless of the thumbscrew adjustment.

The return spring is placed on the toggle linkage, rather than on the operating lever, so that the trigger resistance is a decreasing function of blade extension.

Another feature of the invention is a locking device which, when activated, prevents the blade from extending and thus provides additional safety.

BRIEF DESCRIPTION OF THE DRAWINGS

In the accompanying drawings,

FIGS. 9–11 are, respectively, front, top and end views of a blade storage tray normally seated within a recess in the operating lever.

DESCRIPTION OF THE PREFERRED EMBODIMENT

Figure 1:
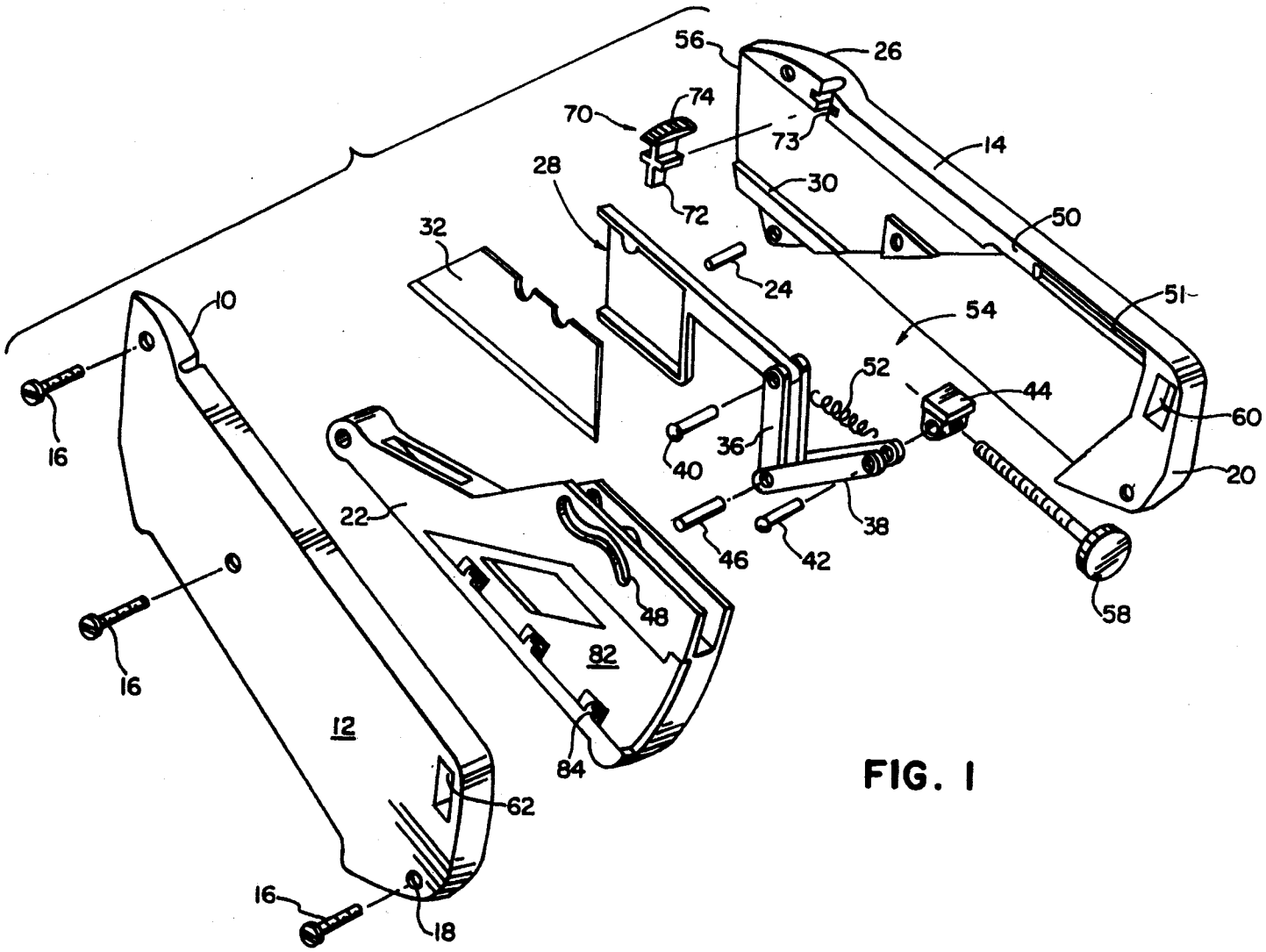
FIG. 1 is an exploded perspective view, from the left side, of a utility knife embodying the invention.
Figure 6:
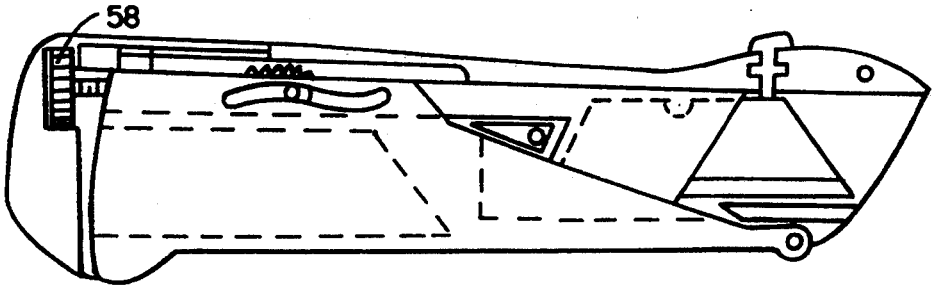
FIG. 6 is a view corresponding to FIG. 5, but with the toggle link support adjusted fully rearward so that the blade is not extended, even though the lever is depressed.
Figure 5:
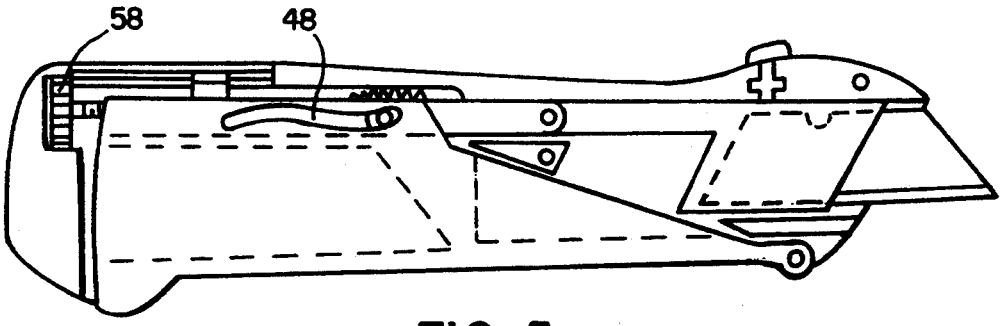
FIG. 5 is a view corresponding to FIG. 2, with the operating lever fully depressed and the blade extended.
Figure 2:
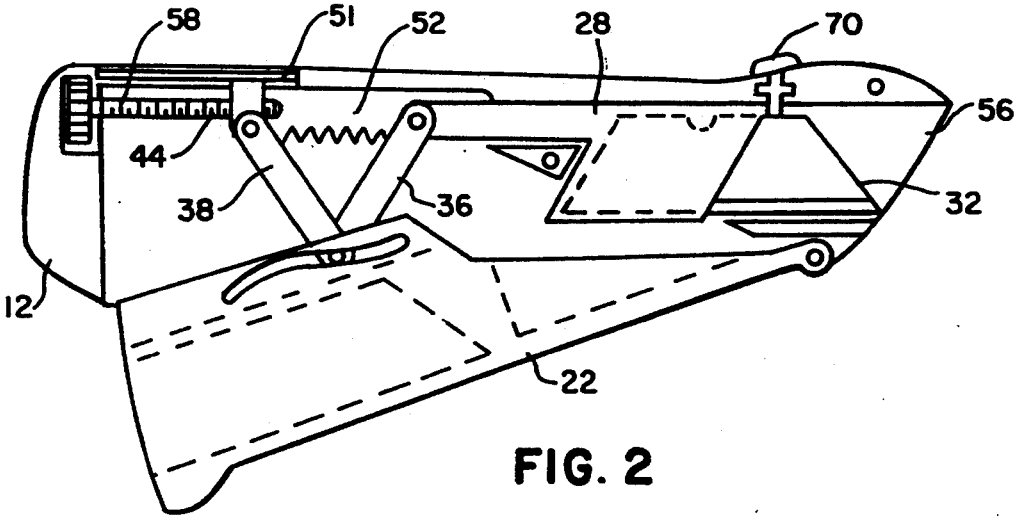
FIG. 2 is simplified sectional view thereof, taken on a vertical plane from the right side of the knife.

A utility knife embodying the invention is shown in FIGS. 1–2. The knife comprises a hollow handle 10 formed in left and right halves 12 and 14, which are held together by screws 16 which pass through holes 18 in the left half into threaded holes 20 in the right half. An operating lever 22, shown in detail in FIGS. 8–11, is supported on a pin 24 whose ends are supported in opposed holes near the front 26 of the handle. A blade holder 28, shown in detail in FIGS. 5 and 6, is slidably supported in recesses 30 at the front of the handle. A conventional utility knife blade 32 is held snugly by the blade holder, so that it can be easily replaced with a sharp blade when necessary.

Figure 3:
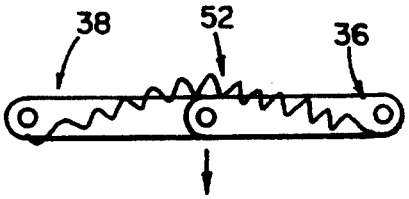
FIG. 3 Is a detail of a toggle linkage shown in FIG. 2.

The blade is moved fore and aft in its recess by a toggle linkage comprising two links 36,38 (see detail of FIG. 3) having a front pin connection 40 to the blade holder, a rear pin 42 connected to an adjustable, but stationary, mount 44 near the rear of the handle, and a central hinge pin 46 which has a greater width than the other two pins, so that its ends extend into respective like slots 48 in either wall 50 of the operating lever. The mount 44 has a two lateral protrusions which ride in slots 51 in the knife housing.

Figure 7:
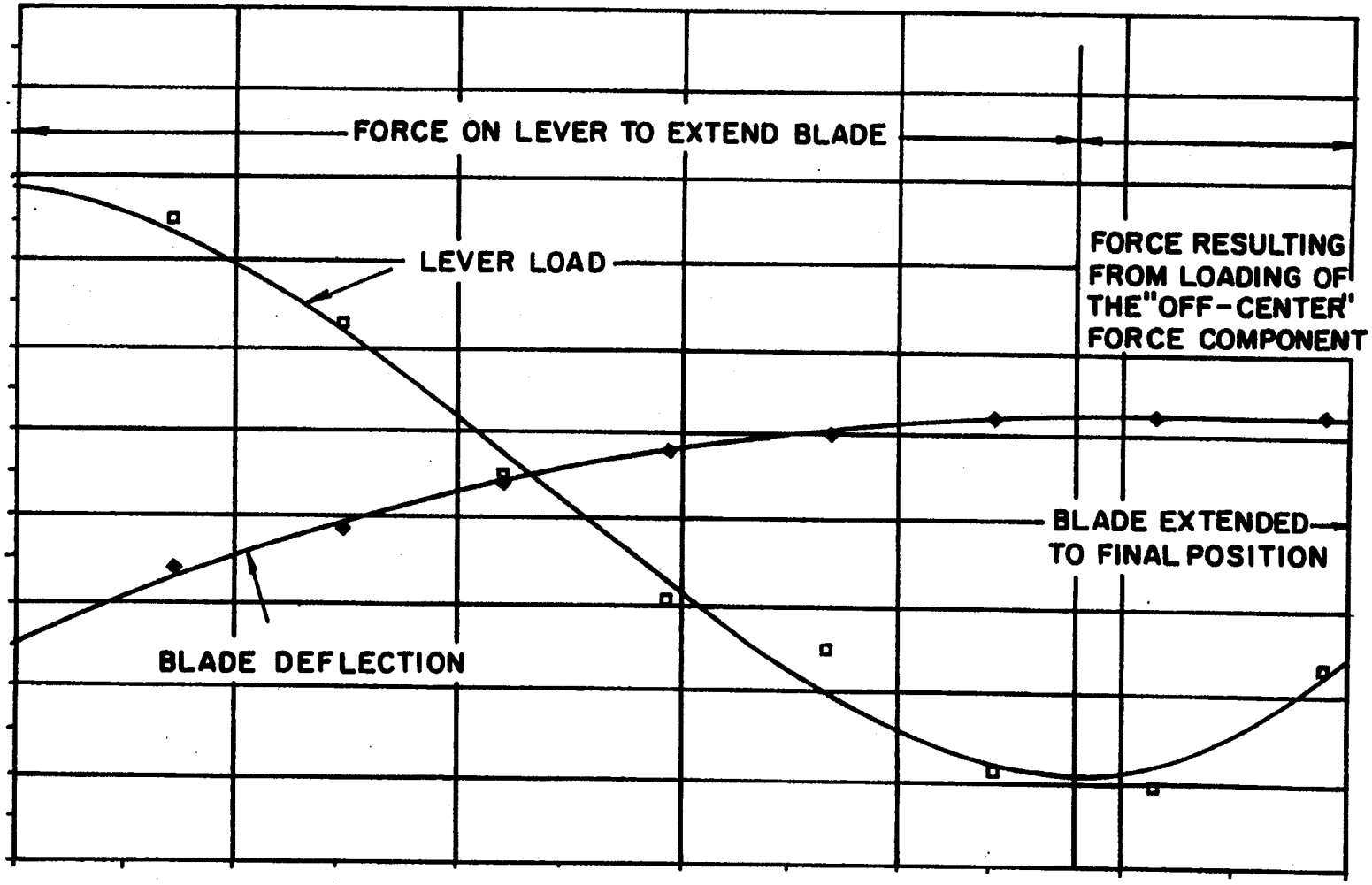
FIG. 7 is a diagram representing typical lever loading and blade extension as a function of lever movement.
Figure 8:
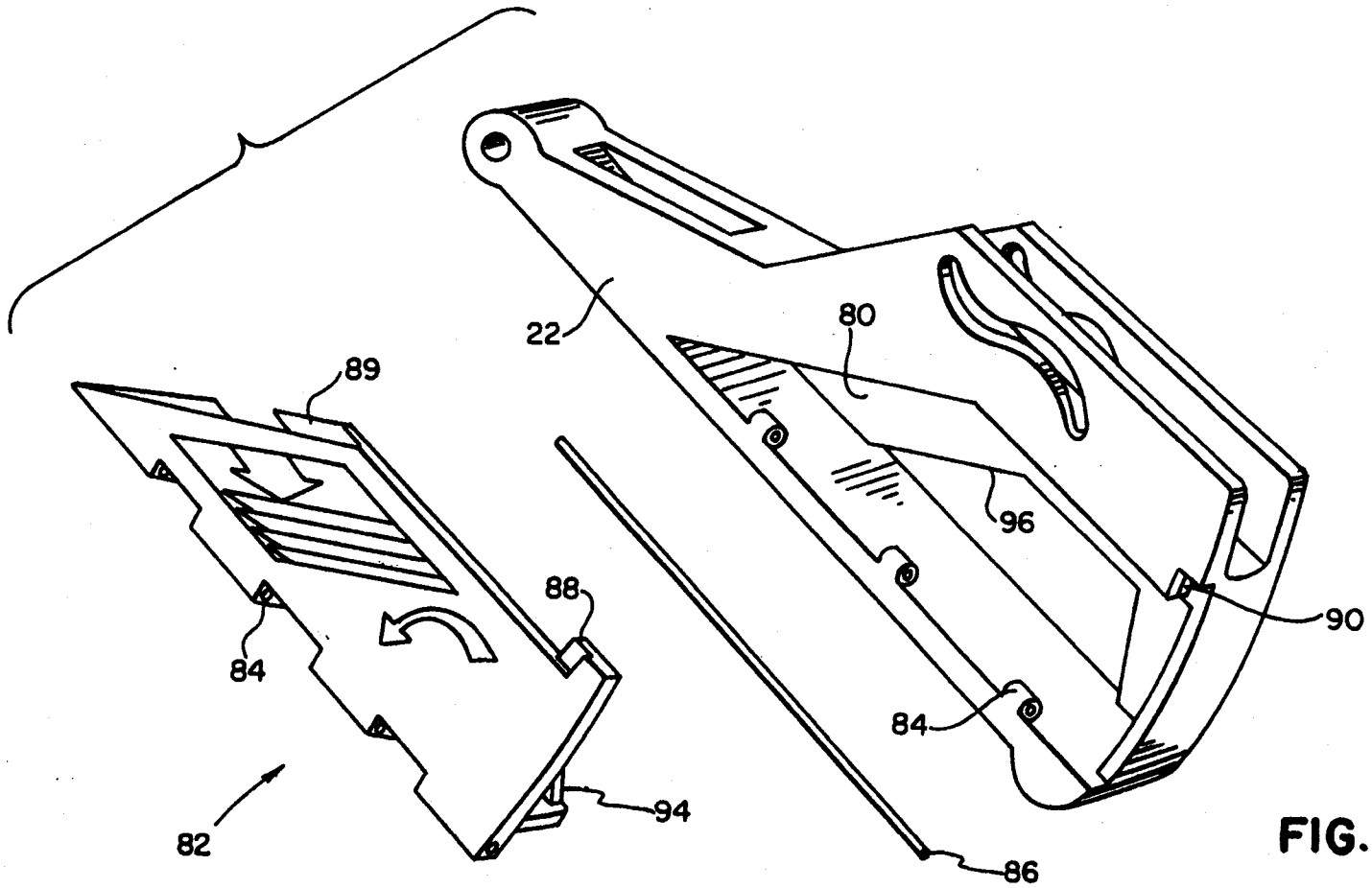
FIG. 8 is an enlarged exploded detail of a portion of the operating lever and a blade magazine which fits inside the lever.

The front and rear pins are drawn together by a coil spring 52 in tension, so that the blade is normally (FIG. 2) retracted to a safe position totally within the handle. In this position, the operating lever is pivoted downward, out of the opening 54 at the bottom of the handle. When the lever is squeezed, however, so that it enters the cavity, the hinge pin of the toggle linkage straightens the links, forcing the blade out of the forward opening 56 of the handle. The increasing mechanical advantage of a toggle linkage, despite increasing spring tension as the lever extends, results in a generally decreasing force diagram, shown in FIG. 7. The units of the graph should be regarded as arbitrary, since actual magnitudes will vary with the dimensions of the parts.

How far the blade protrudes from the handle, in the linkage's fully distended position, is determined by the position of the stationary mount at the rear of the linkage. This position can be adjusted by turning the thumbscrew 58, whose head protrudes from opposite side slots 60,62 at the rear of the handle, to move the mount 44 fore and aft within the handle cavity. FIG. 5 shows the blade substantially extended, while FIG. 6 illustrates the toggle support adjusted fully rearward to keep the blade from protruding at all from the knife housing. Nevertheless, we prefer to provide a safety button 70 as well, at nose of the knife. The safety button has a body 72 with a "t" cross-section, received in a corresponding recess 73 in the handle and a rounded, serrated head 74 which is moved laterally with the thumb between a disengaged position, and one blocking the path of the blade holder, preventing it from extending.

Figure 4:
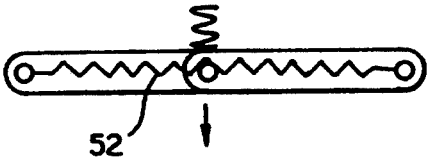
FIG. 4 is a detail of a modified form of the toggle linkage.

The toggle linkage is biased away from its fully distended position, preferably (FIG. 3) by passing the spring over the hinge pin, so that it follows a curved line in the blade-extended position, and thus applies a downward force component on the hinge pin. Alternatively (FIG. 4), a small auxiliary spring may be placed along a line perpendicular to the main spring, biasing the hinge pin, or either link of the toggle, downward. The auxiliary spring, if used, need not be a coil spring; it could be instead a torsion spring, or a cantilever spring associated with one of the links. Any of the above alternatives account for the slight "tail" on the lever loading force curve shown in FIG. 7.

The hinge pin slot shown is arcuate, following an "S" path which has been designed to keep the normal force vector between the pin and the slot at a substantial angle to the length of both links during operation. Should the normal force vector become aligned with one of the links, a large or infinite force would have to be applied to the operating lever in order to move the blade. Thus, the path shape shown provides better feel by avoiding "hard" spots in the lever travel. Depending on the dimensions of the toggle links and other components, a differently shaped slot, even a straight slot, may prove workable.

FIGS. 8–11 show the operating lever 22 in detail. The left side of the lever has a large trapezoidal recess 80 slightly larger in cross-section than a standard utility knife blade 32. A blade tray 82 fits in the recess. The lever and tray have interdigitated hinge fingers 84 through which a common pin 86 passes. The hinge has some axial free play, so that the tray can move a short distance along the axis of the pin. A tab 88 at the upper rear end of the tray seats in a slot 90 at the rear of the handle, securing the tray; a tab 89 at the front end of the tray provides an additional catch. In order to release the tray, it is first moved rearward so that the tabs disengage. As one can see from FIG. 11, the tray is upwardly open; however, when the tray is closed into the recess, the blades are safely confined, The smaller side 94 of the tray, opposite the hinged side, is accessible through a like-sized opening 96 in the right side of the operating lever. This makes it easy to open the tray, once the catch has been released.

Since the invention is subject to modifications and variations, it is intended that the foregoing description and the accompanying drawings shall be interpreted as illustrative of only one form of the invention, whose scope is to be measured by the following claims.

I claim:

1. In a safety utility knife of the type comprising a handle having a cavity with an opening at its forward end and an opening along the bottom of the handle, an operating lever pivotally mounted to the handle and movable with respect to the handle within said bottom opening, a blade holder slidably mounted within said forward opening, a blade removably mounted within the blade holder, a toggle linkage including a pair of links, one of which is connected to the handle by a rearmost pin, the other of which is connected by a foremost pin to the blade holder, the links being interconnected by an intermediate hinge pin which is engaged in a groove in the operating lever, and a spring biasing the blade holder rearward in the handle, the improvement, in combination therewith, comprising a discrete support within the handle, said support having an adjustable but normally fixed position and having means engaging and supporting said rearmost pin, and a helically threaded hole passing through the support on an axis substantially lengthwise of the knife, a helically threaded shaft engaging the support, and a thumbwheel affixed on the threaded shaft, said thumbwheel being accessible from the rear of the knife, so that it can be turned to move the support and thus adjust how far the blade can be extended from the handle.

2. The invention of claim 1, wherein said operating lever is hollow and contains a holder adapted to contain replacement blades.

3. A safety utility knife of the type comprising a blade and a handle, said handle comprising:

a cavity with an opening at its forward end and an opening along the bottom of the handle, an operating lever pivotally mounted to the handle and movable with respect to the handle within said bottom opening, a blade holder slidably mounted within said forward opening, and a linkage interconnecting the lever and the blade holder so that the blade can be extended by squeezing the lever, the improvement comprising a recess in one side of the lever, for holding spare utility knife blades, a blade storage tray normally seated in the recess flush with the sides of the lever in such a way that blades cannot normally be removed from the tray, retaining means interconnecting the tray and the lever, but permitting the tray to move from said normally seated position to an open position where a blade can be removed from the tray, and latching means for securing the tray in said normally seated position.

4. The invention of claim 3, wherein the retaining means is a hinge having a pivot axis passing along corresponding lower edges of the lever and the tray, respectively.

5. The invention of claim 4, wherein the hinge has axial free play so that the tray can be moved along the hinge pivot axis, the lever has an axially extending latching groove, and the tray has a corresponding axially extending tab which normally seats in the groove, but can be withdrawn from it by moving the tray rearward when the tray is to be opened.

* * * * *